US007518326B2

(12) United States Patent
Shier et al.

(10) Patent No.: US 7,518,326 B2
(45) Date of Patent: Apr. 14, 2009

(54) WIRELESS COMMUNICATION SYSTEM FOR A ROLL-UP DOOR

(75) Inventors: William W. Shier, Watertown, WI (US); Lee H. Theusch, Waupun, WI (US); Allan B. Czubin, Oak Creek, WI (US); Robert J. Miller, Waukesha, WI (US)

(73) Assignee: Albany International Corp., Albany, NY (US)

( * ) Notice: Subject to any disclaimer, the term of this patent is extended or adjusted under 35 U.S.C. 154(b) by 51 days.

(21) Appl. No.: 11/655,761

(22) Filed: Jan. 19, 2007

(65) Prior Publication Data

US 2007/0171054 A1 Jul. 26, 2007

Related U.S. Application Data

(60) Provisional application No. 60/761,035, filed on Jan. 20, 2006.

(51) Int. Cl.
*E05F 15/16* (2006.01)
*G08B 1/08* (2006.01)
*G08B 13/08* (2006.01)

(52) U.S. Cl. ..... 318/286; 318/266; 318/468; 318/16

(58) Field of Classification Search ..... 318/16, 318/264–266, 286, 466–470; 340/539.1, 340/545.1

See application file for complete search history.

(56) References Cited

U.S. PATENT DOCUMENTS

| | | | |
|---|---|---|---|
| 4,922,168 | A | 5/1990 | Waggamon et al. |
| 5,228,492 | A | 7/1993 | Jou |
| 5,323,149 | A | 6/1994 | Hoult et al. |
| 5,412,297 | A | 5/1995 | Clark et al. |
| 5,465,081 | A | 11/1995 | Todd |
| 5,493,812 | A | 2/1996 | Teich |
| 5,541,585 | A | 7/1996 | Duhame et al. |
| 5,584,145 | A | 12/1996 | Teich |
| 5,596,840 | A | 1/1997 | Teich |
| 5,625,980 | A | 5/1997 | Teich et al. |
| 5,721,550 | A | 2/1998 | Lopez |

(Continued)

FOREIGN PATENT DOCUMENTS

| | | |
|---|---|---|
| DE | 102 19 852 A | 3/2003 |

(Continued)

*Primary Examiner*—Bentsu Ro
(74) *Attorney, Agent, or Firm*—Frommer Lawrence & Haug LLP; Ronald R Santucci

(57) ABSTRACT

A door system includes a support connected to a structure, and a door mounted on the support and movable relative to the support between an opened position and a closed position. The door includes a detection device and a remote module coupled to the detection device. The remote module includes a battery and an RF module for supporting two-way communication and sending signals indicative of the status of the detection device and the battery. The door system also includes a motor to drive the door, and a controller to control the motor. The controller includes a user interface and a memory. The door system also includes a base module coupled to the controller for receiving signals from the remote module. The received signals are indicative of the status of the detection device and the battery. The base module also sends signals related to successful transmission acknowledgements to the remote module.

30 Claims, 6 Drawing Sheets

U.S. PATENT DOCUMENTS

| | | | |
|---|---|---|---|
| 5,912,625 | A | 6/1999 | Scofield |
| 6,020,703 | A | 2/2000 | Telmet |
| 6,070,361 | A | 6/2000 | Paterno |
| 6,072,404 | A | 6/2000 | Nolan et al. |
| 6,075,333 | A | 6/2000 | Huddle |
| 6,082,046 | A | 7/2000 | Simmons |
| 6,176,039 | B1 | 1/2001 | Craig |
| 6,181,095 | B1 | 1/2001 | Telmet |
| 6,181,255 | B1 | 1/2001 | Crimmins et al. |
| 6,218,929 | B1 | 4/2001 | Furuta et al. |
| 6,281,599 | B1 | 8/2001 | Murakami et al. |
| 6,346,889 | B1 | 2/2002 | Moss |
| 6,484,784 | B1 | 11/2002 | Weik, III et al. |
| 6,566,828 | B2 | 5/2003 | Fitzgibbon et al. |
| 6,634,408 | B2 | 10/2003 | Mays |
| 6,720,861 | B1 | 4/2004 | Rodenbeck et al. |
| 6,727,816 | B1 | 4/2004 | Helgeson |
| 6,732,476 | B2 | 5/2004 | Mehalshick et al. |
| 6,873,127 | B2 | 3/2005 | Murray |
| 6,873,260 | B2 | 3/2005 | Lancos et al. |
| 2002/0130788 | A1 | 9/2002 | Chang |
| 2002/0178385 | A1 | 11/2002 | Dent et al. |
| 2002/0180600 | A1* | 12/2002 | Kirkland et al. ..... 340/545.1 |
| 2002/0183008 | A1 | 12/2002 | Menard et al. |
| 2003/0096607 | A1* | 5/2003 | Taylor ..... 455/425 |
| 2003/0160681 | A1 | 8/2003 | Menard et al. |
| 2003/0169207 | A1 | 9/2003 | Beigel |
| 2005/0055582 | A1 | 3/2005 | Bazakos et al. |
| 2005/0134426 | A1 | 6/2005 | Mullet et al. |
| 2005/0269984 | A1 | 12/2005 | Piechowiak et al. |
| 2006/0164291 | A1 | 7/2006 | Gunnarsson |
| 2006/0254729 | A1* | 11/2006 | Mays ..... 160/188 |
| 2006/0261951 | A1* | 11/2006 | Koerner et al. ..... 340/572.1 |
| 2007/0046232 | A1* | 3/2007 | Mullet et al. ..... 318/280 |
| 2008/0016771 | A1* | 1/2008 | Marchetto ..... 49/26 |

FOREIGN PATENT DOCUMENTS

| | | |
|---|---|---|
| EP | 1 467 322 A | 10/2004 |
| WO | WO 02/35036 | 5/2002 |

* cited by examiner

WIRELESS COMMUNICATION SYSTEM FOR A ROLL-UP DOOR

RELATED APPLICATIONS

This application claims priority to U.S. Provisional Patent Application No. 60/761,035; filed on Jan. 20, 2006.

BACKGROUND

The present invention relates to a door system and method of operating the same. For example, current high-speed roll-up door systems utilize a coiled cord (or "coil-cord") to provide communication between bottom-bar devices, which are mounted on the roll-up door of the system, and a controller generally mounted on the nearby structure of a building. Typically, the coil-cord is connected between the bottom-bar of the door and an electrical junction mounted on the building near the top of the door. Additional cabling is necessary to connect the electrical junction to the controller. Because of the constant movement of the door, the coil-cord can fatigue, break, and tangle with door parts and supports. The flapping coil-cord can also cause false photosensitive safety device trips. Coil-cords are also expensive to purchase and time consuming to install and service.

SUMMARY

The invention provides a wireless system to allow communication between the bottom-bar devices, the controller, and other electronics mounted on the door. The wireless system can be applied to a roll-up door, a spiral door, a folding door, a sectional door, a high-lift door, and other types of doors suitable for automated operation. In the particular case of a roll-up door, the wireless system replaces the typical coil-cord connection between the motor controller mounted on the structure of the building and the bottom-bar devices mounted on the roll-up door. The wireless system can include a wireless RF, optical, IR or other wireless device. The wireless system thus eliminates the need for the coil-cord and facilitates the required communication between the controller and the bottom-bar devices and other door-mounted electronics.

In one embodiment, the invention provides a door system adapted to be mounted to a structure. The door system comprises a support connected to the structure, and a door mounted on the support and movable relative to the support between an opened position and a closed position. The door includes a detection device coupled to the door, and a remote module coupled to the detection device. The remote module includes a battery for powering the remote module, and an RF module for supporting two-way communication and sending signals indicative of the status of the detection device and the battery. The door system also includes a motor coupled to the door to drive the door, a controller coupled to the motor to control the motor, the controller including a user interface and a memory, and a base module coupled to the controller for receiving signals from the remote module. The received signals are indicative of the status of the detection device and the battery. The base module also sends signals related to successful transmission acknowledgements to the remote module.

In another embodiment, the invention provides a method of operating a remote module coupled to a detection device. The remote module includes a battery for powering the remote module, and an RF module for supporting wireless two-way communication with a base module. The method comprises, in a first mode, transmitting a signal indicative of the status of the detection device and the battery, and switching from the first mode to a second mode in response to transmitting the signal. The electric current consumption in the first mode is larger than in the second mode. The method also includes, in the second mode, verifying if another signal from the base module has been received, where the other signal is indicative of a transmission acknowledgment. The method also includes, in the second mode, verifying the status of the detection device and the battery, and switching from the second mode to a third mode in response to the remote module verifying that the status is the same as the status transmitted in the first mode. The electric current consumption in the second mode is larger than in the third mode. The method also includes, in the third mode, verifying that a timer has expired. The timer controls the amount of time the remote module operates in the third mode. The method also includes, in the third mode, shutting down the RF module in response to the timer being expired, and switching from the third mode to a fourth mode in response to shutting down the RF module. The electric current consumption in the third mode is larger than in the fourth mode. The method also includes, in the fourth mode, verifying that a watchdog timer has expired.

In another embodiment, the invention provides a method of operating a door system having a door mounted on a support, where the door has a detection device, and a remote module coupled to the detection device. The remote module includes a battery for powering the remote module, and an RF module for supporting two-way communication. The door system also includes a motor for driving the door, a controller for controlling the motor, and a base module coupled to the controller. The base module supports two-way communication with the remote module. The method includes operating the remote module in a first mode of the system, and transmitting a signal with the remote module, where the signal is indicative of the status of the detection device and the battery. The method also includes operating the motor with the controller based on the signal transmitted, operating the remote module in a second mode of the system, and transmitting another signal with the base module. The signal is indicative of an acknowledgement of reception of the signal from the remote module. The method also includes operating the remote module in a third mode of the system, shutting down the RF module, and operating the remote module in a fourth mode of the system. The method also includes switching operation of the remote module to the first mode in response to a watchdog timer expiring.

In another embodiment, the invention provides a method for setting-up a wireless system for a door. The method includes providing a remote module with an RF module and a battery, providing a controller with a base module, and programming an address in the remote controller. The method also includes coupling the remote module to a detection device, setting the remote module to a standby mode, and enclosing the remote module and the detection device in a bottom-bar assembly. The method also includes coupling the bottom-bar assembly to the door, triggering an event with the detection device, and transmitting a signal with the remote module to the base module as a result of triggering the event, the signal indicative of the status of the detection device and battery.

Other aspects of the invention will become apparent by consideration of the detailed description and accompanying drawings.

DETAILED DESCRIPTION

Figure 1:
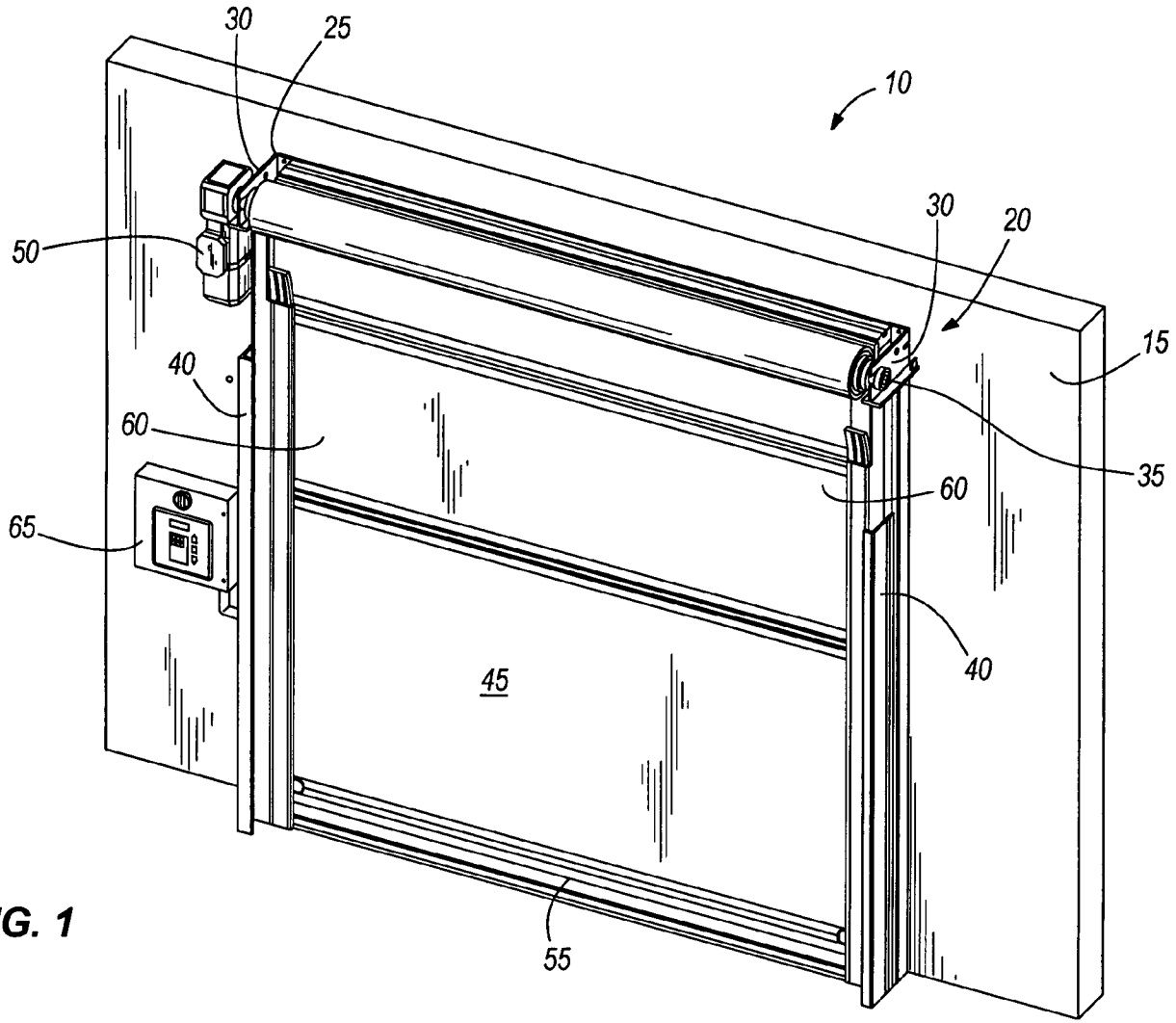
FIG. 1 is a perspective view of a roll-up door system according to one embodiment of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. The terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings, and can include electrical connections or couplings, whether direct or indirect.

In addition, it should be understood that embodiments of the invention include both hardware and software components or modules that, for purposes of discussion, can be illustrated and described as if the majority of the components were implemented solely in hardware. However, one of ordinary skill in the art, and based on a reading of this detailed description, would recognize that, in at least one embodiment, the electronic based aspects of the invention can be implemented in software. As such, it should be noted that a plurality of hardware and software based devices, as well as a plurality of different structural components can be utilized to implement the invention. Furthermore, and as described in subsequent paragraphs, the specific configurations in the drawings are intended to exemplify embodiments of the invention and that other alternative configurations are possible.

FIG. 1 is a perspective view of a roll-up door system 10 according to one embodiment of the present invention. The roll-up door system 10 is generally mounted on a structure 15 and defines at least an opened position (not shown) and a closed position, as shown in FIG. 1. The roll-up door system 10 includes a support system 20 having a horizontal support 25 generally attached to the structure 15. The support system 20 also has side brackets 30 extending from the horizontal support 25 for supporting an axle or rotating shaft 35, and vertical supports or rails 40. The shaft 35 supports a roll-up door 45 and is coupled to a motor 50 for driving the roll-up door 45 between the opened position and the closed position. It is to be understood that the roll-up door system 10 is one exemplary construction and other door systems fall within the scope of the invention. For example, other door systems encompassing the invention can include a spiral door, a folding door, a sectional door, a high-lift door, and other door types suitable for automated operation.

In the particular case of the roll-up door system 10, the roll-up door 45 is generally manufactured of a flexible and/or resilient material allowing the door 45 to deform in the form of a roll supported by the shaft 35, for example. The roll-up door 45 is coupled to rails 40 along the sides 60 of the door 45. The roll-up door 45 includes a bottom-bar assembly 55 coupled to the lower portion of the roll-up door 45. The bottom-bar assembly 55 defines an elongated hollow structure and helps sides 60 of the roll-up door 45 to be substantially aligned with the vertical supports 40. It is to be understood that the roll-up door system 10 illustrated in FIG. 1 is for illustration purposes only and other constructions fall within the scope of the invention.

Figure 2:
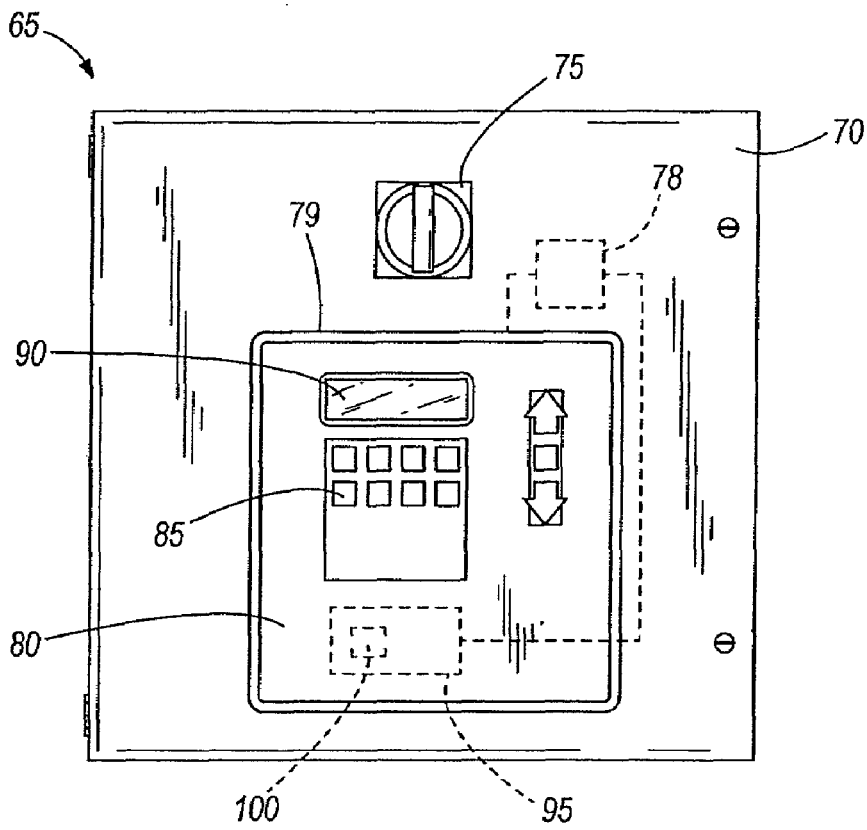
FIG. 2 is an elevation view of a controller of the roll-up door system shown in FIG. 1.

With reference to FIGS. 1 and 2, the roll-up door system 10 includes a controller 65 electrically coupled to the motor 50 for controlling the operation of the motor 50. The controller 65 includes an enclosure 70 generally mounted on the structure 15 adjacent to the roll-up door 45 and the motor 50. The enclosure is also placed such that the enclosure 70 provides easy access for a user. The controller 65 also includes a PCB with a microcontroller 78 supported within the enclosure 70. The microcontroller 78 is configured to carry out all the operational functions of the roll-up door system 10 by utilizing the capabilities of various input and output ("I/O") modules coupled to the microcontroller 78. For example, the microcontroller 78 can include as standard features a power supply and normal activator inputs, safety inputs, and a motor drive/encoder interface. Additionally, the microcontroller 78 can include optional functionality such as loop, refrigeration, and relay outputs.

The enclosure 70 of the controller 65 can include a locking mechanism 75 to provide restricted access to the microcontroller 78 and other systems or electronics supported within the enclosure 70. The enclosure 70 can also include a user interface 79. The user interface 79 can include a plastic key pad and display feature 80. The key pad and display feature 80 generally includes a number of buttons 85 and a display screen 90 coupled to the controller and allowing for setup, monitoring, and controlling of the controller 65. The roll-up door system 10 also includes a programmable base module 95 supported within the enclosure 70 of the controller 65. The base module 95 includes a radio frequency (RF) transceiver module 100, such as the ZigBee Ready Modules FreeStar and Z-Star provided by L. S. Research. Generally, the base module 95 is mounted within the enclosure 70 and near the plastic key pad and display feature 80 allowing for easier transmission and reception of signals through the plastic feature 80. In other embodiments (not shown), the base module 95 and RF transceiver module 100 can be completely integrated within the controller 65.

Figure 3:
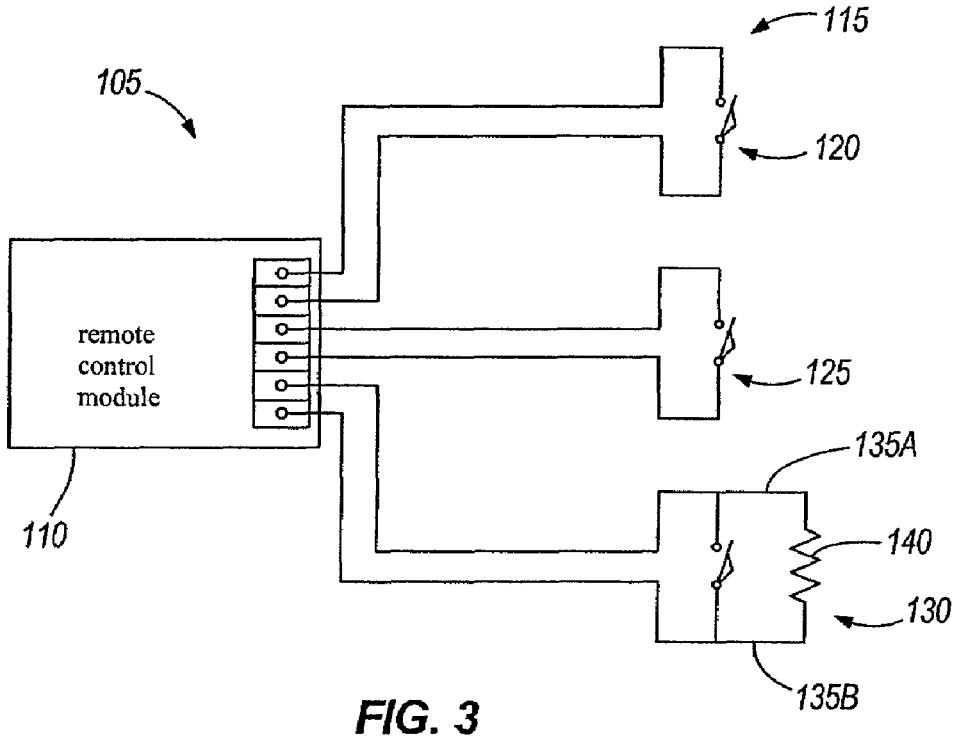
FIG. 3 is a schematic representation of a remote module coupled to a set of bottom bar devices of the roll-up door system shown in FIG. 1.
Figure 6:
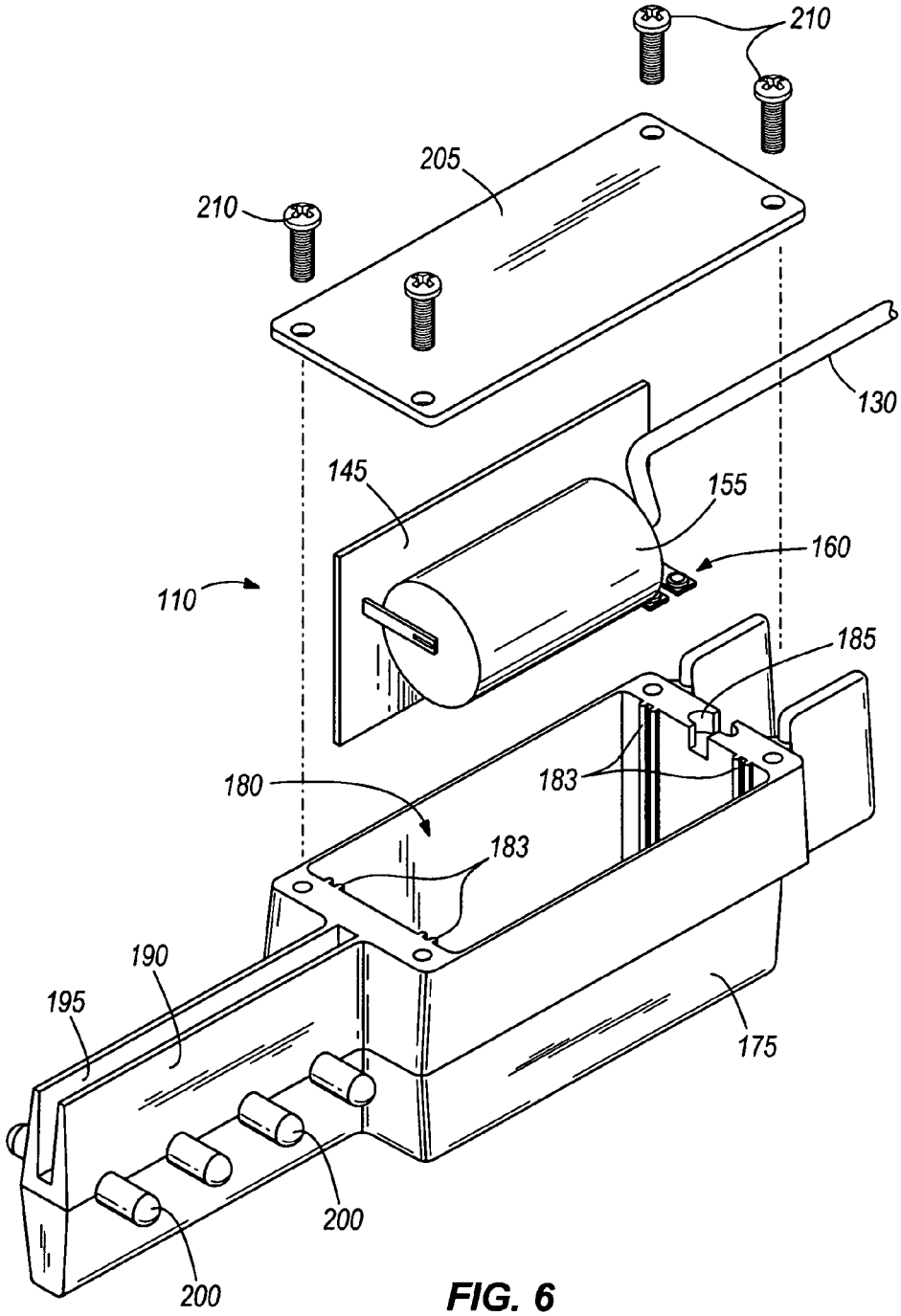
FIG. 6 is an exploded view of the remote module shown in FIG. 4 and a portion bottom-bar assembly.
Figure 7:
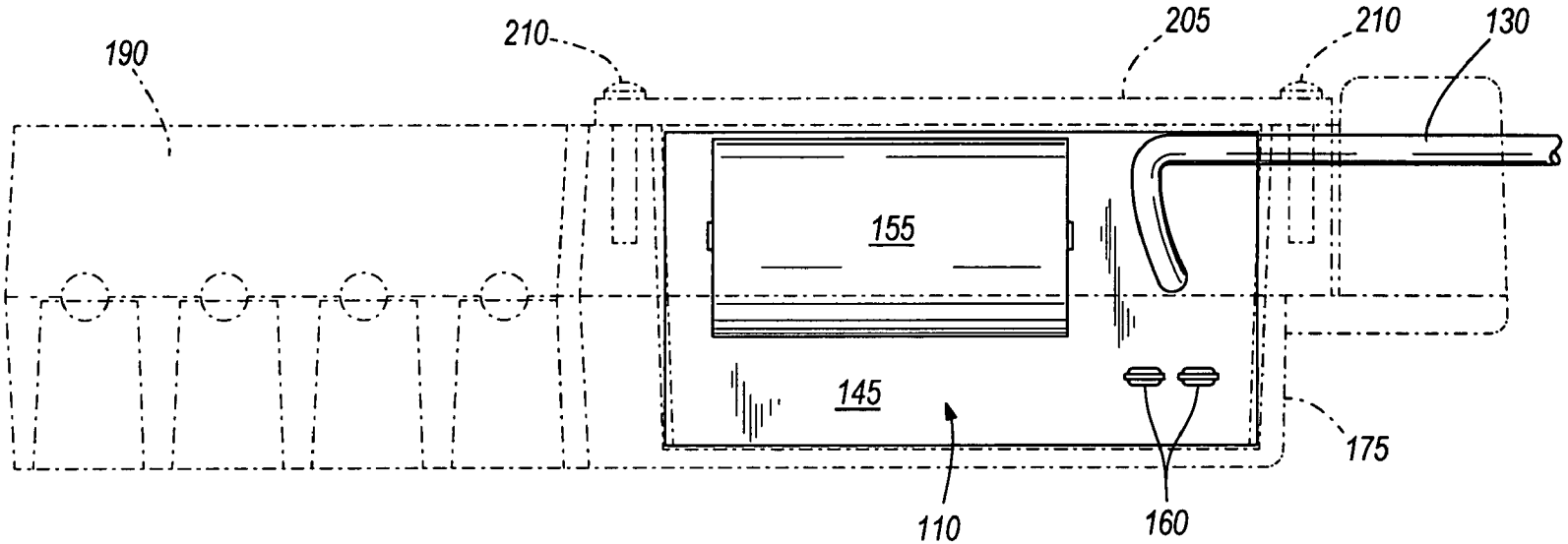
FIG. 7 is a side elevation view of the remote module and the portion of the bottom-bar assembly shown in FIG. 6, with portions of the drawing illustrated in phantom to show the interior of the remote module.

With reference to FIG. 3, the roll-up door system 10 also includes a set of bottom-bar devices 105 generally supported at least partially within the bottom-bar assembly 55. The bottom-bar devices 105 include a battery operated remote module 110 (also shown in FIGS. 4 and 5) and a set of detection devices 115. In this particular construction, the detection devices 115 include a first breakaway switch 120, a second breakaway switch 125, and a reversing edge tape switch 130. Coupling of the reversing edge tape switch 130 with the remote mode 110 according to one construction of the present invention is shown in FIGS. 6 and 7. The reversing edge tape switch 130 is a fail safe device including two conductive paths 135A and 135B. The conductive paths 135A and 135B run along the width of the roll-up door 45 and are connected in serial configuration by a resistor 140. For example, the resistor 140 can include a resistance value of 68.1 kΩ±1%.

The resistor 140 allows the remote module 110 to detect the presence of the reversing edge tape switch 130, while still being capable of differentiating between a full short or "trip" of the reversing edge tape switch 130 and proper connection of the conductive paths 135A and 135B in an undisturbed position, for example. The breakaway switches 120 and 125 are normally open, as shown in FIG. 3. The breakaway switches 120 and 125 are located one at each side or edge 60 of the roll-up door 45. Generally, the breakaway switches 120 and 125 are configured to help protect the door 45 from damage when the door 45 falls out of alignment with tracks defined by the vertical supports 40. For example, in cases when the door 45 falls out of alignment with the tracks of the vertical supports 40, one or both breakaway switches 120, 125 are tripped causing the remote module to communicate a change of status to the base module 95. Accordingly, the controller 65 can control the motor 50 to stop movement of the door 45 as a result of the base module 95 receiving the signal indicate of the change of status of the detection devices 115.

Figure 5:
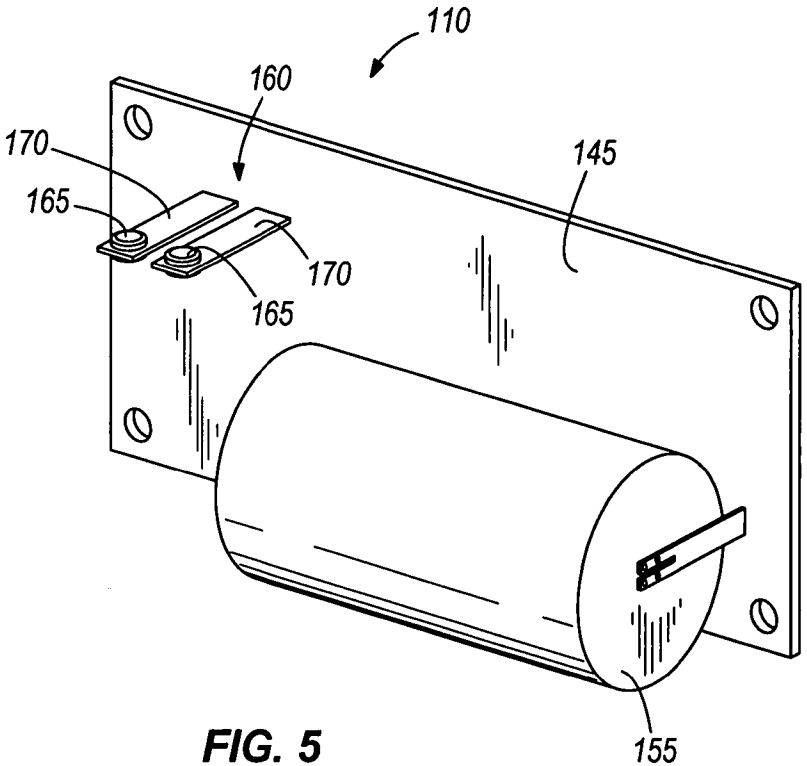
FIG. 5 is a frontal perspective view of the remote module shown in FIG. 4.
Figure 4:
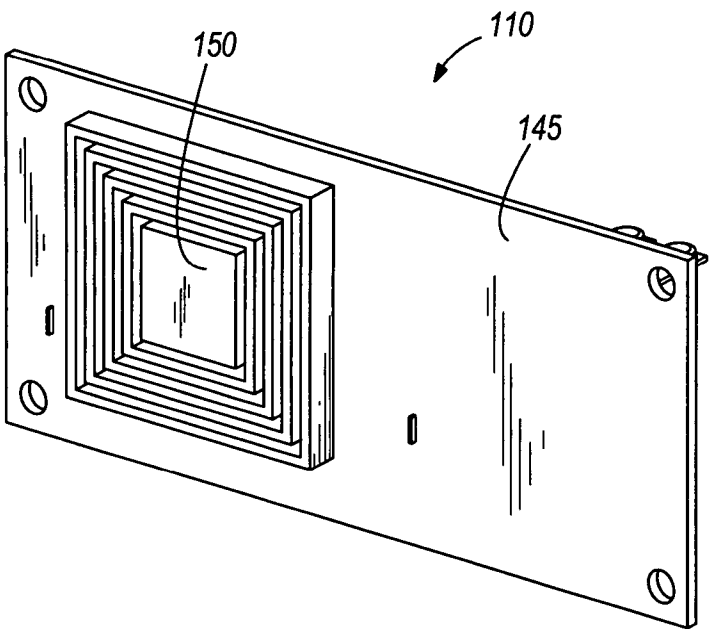
FIG. 4 is a posterior perspective view of the remote module schematically shown in FIG. 3.

FIGS. 4 and 5 illustrate one construction of the remote module 110 including a printed circuit board 145 supporting a controller, and a universal synchronous/asynchronous receiver transmitter (USART). The remote module 110 also includes a RF module 150 with an incorporated antenna, a battery 155, and a pair of vibration or motion sensors 160. Alternatively, the remote module 110 can include other wireless devices for supporting wireless, two-way communication. For example, the remote module 110 can include an optical communication system, an infrared ("IR") device, a laser, or other wireless devices. The remote module 110 is supported within the bottom-bar assembly 55, which can be manufactured of a metal such as aluminum, or a rubber material. In the particular case when the bottom-bar assembly 55 is formed of a metal, the bottom-bar assembly 55 includes an aperture (not shown) such that the remote module 110 can be mounted near the aperture to improve functionality of the antenna of the RF module 150. Moreover, the remote module 110 can be further enclosed or contained in a sealed package to protect the remote module 110 from environmental factors such as moisture and frost.

The RF module 150 can include a RF transceiver unit that is configured to operate in the 2.4 GHz band. For example, the RF module 150 can include the FreeStar RF module provided by L. S. Research, similar to transceiver module 100 of the base module 95 mounted within the enclose 70 of the controller 65. For this particular example, the remote module 150 can be operated and monitored through a fixed channel in a personal area network (PAN). This facilitates easy integration of the controller 65 (or a plurality of controllers) into a building-wise security system. For that purpose, the remote module 150 includes a unique address, which can be serialized at the time of manufacture such that no two remote modules have the same addressing parameters.

In the case when the remote module 150 is incorporated into a PAN, the PAN can include a number of sub-channels including sub-channels in the 2.4 GHz frequency band, as mentioned above. In a PAN, only devices (such as the base module 95 or a personal computer) including the same PAN ID can communicate with each other. Accordingly, it is envisioned that a user with a wireless capable personal computer can monitor and control the operation of the base module 95 and the remote module 110 from the personal computer or the like. Moreover, by incorporating the remote module 110 and the base module 95 to a PAN, a user can increase security and avoid interference with similar systems, because each module 95 and 110 can be personalized with one of 65000 "short" addresses within 16000 PAN IDs and 16 different sub-channels. Over all, each module 95 and 110 can be manufactured with one of 17 billion address combinations. Additionally, the modules implement carrier sense multiple access (CSMA) communication technology to help ensure clear transmission of information within the PAN.

The battery 155 shown in FIGS. 4 and 5 can include a battery module having a number of cells. In some cases, the battery 155 can include a single C—cell 3.6 Lithium battery 8.4 AH rated for a "functional life" of about 6 years and a "shelf-life" of about 10 years. Other sources of power for the remote module 110 are also included within the scope of the invention. The motion sensors 160 are provided with the remote module 110 for safety in redundancy and for ensuring that motion of the roll-up door 45 is detected. In some constructions, the motion sensors 160 are weighted piezo-film elements, each including a mass or weight 165 and a film 170, that are coupled directly to the PCB 145 of the remote module 110.

The motion sensors 160 produce a voltage detected by the controller of the remote module 110 as the films 170 are strained due at least in part to the inertial relative movement of the weights 165. For example, the motion sensors 160 can include two MiniSense 100 vibration sensors provided by MSI Sensors. The motion sensors 160, as shown in FIG. 5, are oriented to detect motion primarily in the vertical direction, which is the general direction of motion of the roll-up door 45. Accordingly, the orientation of the sensors 160 allows the remote module 110 to be relatively insensitive to vibrations of the roll-up door 45 in the horizontal direction, such as are caused by wind or abrupt pressure fluctuations about the door 45.

FIGS. 6 and 7 illustrate a portion of the bottom-bar assembly 55 supporting the remote module 110. As shown in FIG. 6, the bottom-bar assembly 55 includes a bottom-bar end block 175 defining an inner space 180, and having vertical tracks 183, a route slot 185, and a projection 190. The projection 190 extends at the opposite end of the bottom-bar end block 175 with respect to the route slot 185. The projection 190 includes a vertical slot 195 and pins 200 extending substantially perpendicular to the slot 195. With respect to FIGS. 1 and 6, the projection 190 is placed loosely within the tracks of the vertical supports 40 allowing the roll-up door 45 to stay in alignment with the vertical supports 40. The bottom-bar assembly 55 also includes a module cover plate 205 designed to be coupled to the end block 175 with screws 210. It is to be understood that the bottom-bar assembly 55 can include other means to support the remote module 110.

Prior to mounting the remote module 110 to the bottom-bar assembly 55, as shown in FIG. 7, the manufacturing process includes setting the remote module 110 in a "standby" mode and labeling the assembly 55 with the RFID of the remote module 110. As shown in FIG. 7, the vertical edges of the PCB 145 tightly fit within the tracks 183 of the end block 175. Moreover, it can be observed that the remote module 110 is sized such that the PCB 145 fits tightly between the cover plate 205 and the bottom of the end block 175. The arrangement shown in FIG. 7 helps avoid movement of the remote module 110 with respect to the assembly 55 during operation of the roll-up door system 10, thus avoiding damage or communication faults between the remote module 110 and the base module 95. As shown in FIGS. 6 and 7, a cable corresponding to the reversing edge tape switch 130 is coupled to the PCB 145 and extends through the route slot 185. The manufacturing process can include placing a sealant material (e.g. silicon) within the route slot 185 to seal the bottom-bar end block 175.

During operation of the roll-up door system 10, the microcontroller 78 of the controller 65 maintains constant polling communication with the I/O modules coupled to the microcontroller 78. Particularly the base module 95 communicates with the microcontroller 78, through at least one input and/or output ("I/O") points, and operates simultaneously with other I/O modules coupled to and operated by the microcontroller 78. The programmable feature of the base module 95 allows the I/O points of the base module 95 to be mapped to a number of functions of the door 45. The reversing edge tape switch 130 acts as a safety device to prevent the roll-up door 45 from causing damage or injury while the door 45 is actuated between the open position and the closed position. For example, a trip of the reversing edge tape switch 130 can cause the controller 65 to operate the motor 50 and open the roll-up door 45 to the open position. Additionally, a trip of at least one of the breakaway switches 120 and 125, generally caused by the door 45 leaving the tracks of the vertical supports 40, can cause the controller 65 to initiate a repair sequence including operating the motor 50 to set the roll-up door 45 in a stand still position.

The remote module 110 monitors and communicates to the base module 95 the status and changes in the status of the reversing edge tape switch 130 and the breakaway switches 120 and 125. More specifically, the remote module 110 communicates the status of the switches 120, 125, and 130 whether or not motion is detected by the motion sensors 160. However, changes in the status of the motion sensors 160 can also trigger the transmission of information between the remote module 110 and the base module 95. For example, motion detected by the motion sensors 160 after a quiet period (for example, no change in the status of the switches 120, 125, and 130) triggers the transmission of the status of the switches 120, 125, and 130. Therefore, changes in the status of the switches 120, 125, and 130 and motion sensors 160 are communicated immediately to the base module 95.

The status of the reversing edge tape switch 130 is communicated every time the remote module 110 transmits to the base module 95. Additionally, the configuration of the reversing edge tape switch 130 allows the remote module 110 to monitor and report the condition of the wiring in the switch 130. Because the conductive paths 135A and 135B are connected in a series configuration with resistor 140, the remote module 110 can detect when damaged wiring has caused a disruption in one of the conductive paths 135A and 135B, thus creating an open circuit.

The remote module 110 also monitors and communicates to the base module 95 the status of the battery 155. More specifically, battery voltage level is polled regularly by the remote module 110 allowing the controller 65 to display a low-battery condition, for example. Because the voltage of the battery 155 can be affected by ambient conditions such as cold weather, the remote module 110 can also include a temperature sensor (not shown) allowing the remote module 110 to transmit temperature information to the base module 95. The microcontroller 78 utilizes temperature information and relates the information to the voltage levels of battery 155 to determine whether a "low battery" condition exists. It is envisioned that the controller 65 displays battery status, such as low battery status, with a significant time frame prior to the expiration of the battery 155 (approximately one month, for example) regardless of temperature and environmental conditions under which the system 10 is operating.

The flow chart 300 also illustrates the operation of the remote module 110 once a commissioning sequence is triggered. The remote module 110 and the base module 95 can be completely assembled and tested prior to starting the commissioning sequence. For example, switches 120, 125, and 130 can be deliberately actuated to determine whether or not the remote module 10 senses a change in the status of the switches 120, 125, and 130 and the battery 155. Subsequently, the modules 95 and 110 are put in the standby mode until the commissioning sequence is started at an operating site. At the operating site, the commissioning sequence is started by manually entering, through the key pad and display feature 80, the serialized communications address of the modules 95 and 110.

The commissioning sequence includes provoking a "breakaway" event by triggering at least one of the switches 120, 125, and 130. The breakaway event causes the remote module 110 to be in a full "ready" status and to start executing the operational software such as the one illustrated as flow chart 300. Once the remote module 110 is in the full ready status, the software programs of the base module 95 and the remote module 110 work together such that 2-way communication exists between the remote module 110 and the base module 95 starting with the triggering of the commissioning sequence and thereafter. More specifically, the base module 95 does not operate or act on I/O information from the remote module 110 until the commissioning sequence is started.

Figure 8:
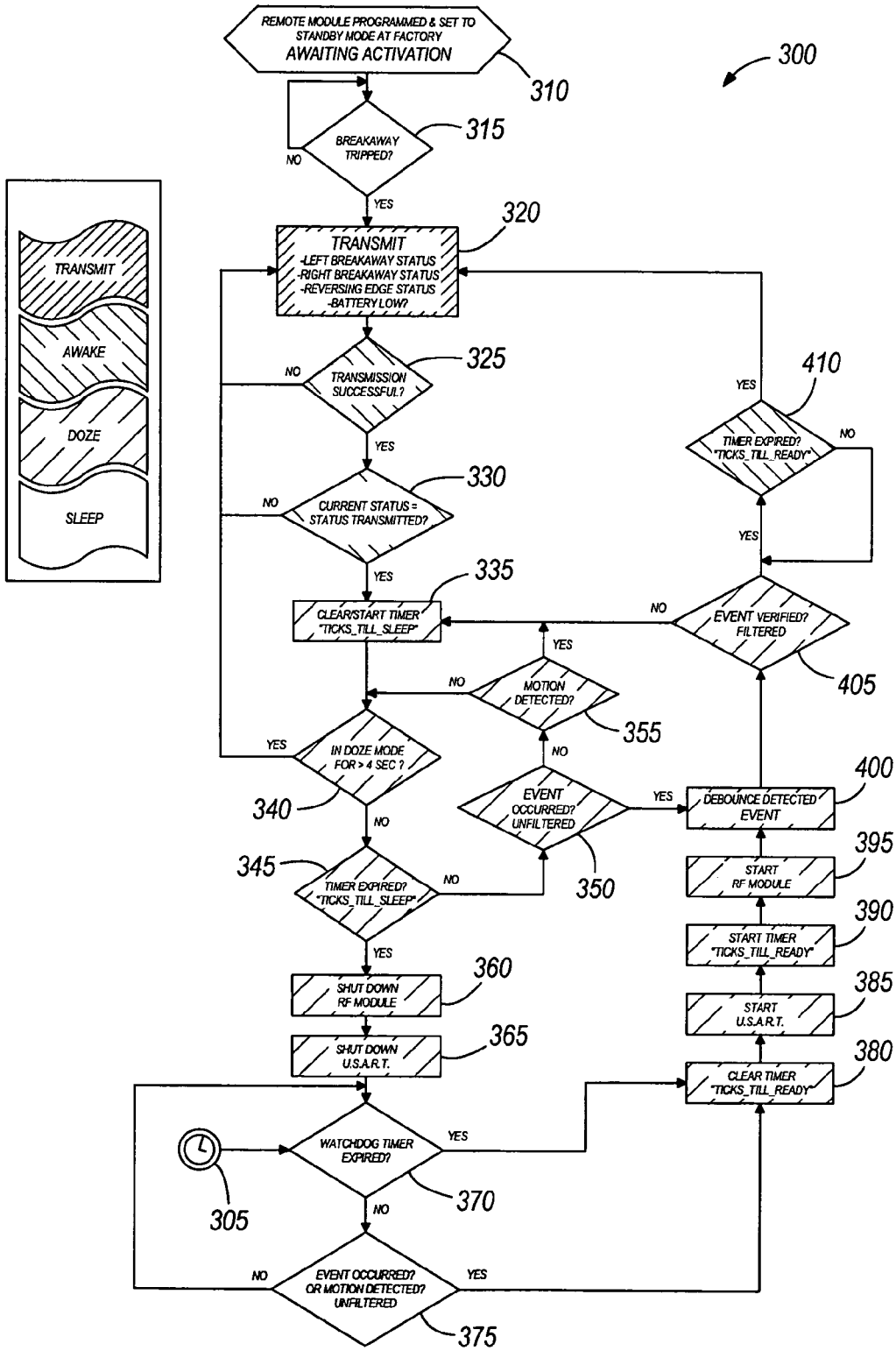
FIG. 8 is a flow chart illustrating the operation of the remote module shown in FIG. 3.

The flow chart 300 in FIG. 8 illustrates the operation of the remote module 110 as a function of current consumed by the remote module 110. More specifically, the flow chart 300 illustrates the operation of a software program in the remote module 110. The software program is programmed in the remote module 110 in computer readable code during the manufacturing process. The flow chart 300 indicates that the remote module 110 operates in four states or modes, each mode being characterized by the current consumption of the remote module 110. The remote module 110 operates in a "TRANSMIT" mode, an "AWAKE" mode, a "DOZE" mode, and a "SLEEP" mode (also described as standby mode). In the TRANSMIT mode, the remote module 110 is enabled to receive signals, and is ready to transmit signals to the base module 95, and consumes battery current in a range between about 35 mA and 150 mA. That is, the circuitry of the remote module 110 is consuming between 35 mA and 150 mA of electric current from the battery. In AWAKE mode, the RF module 150 is active, and the controller of the remote module 110 is active and processing events. In AWAKE mode, the RM 110 consumes current of about 2 mA. In the DOZE, the RF module 150 is inactive, the controller of the remote module 110 is active, and the current consumption is about 222 μA. In the SLEEP mode, the RF module 150 is inactive, the controller of the remote module 110 is inactive until triggered by an event or a watchdog timer 305, and the current consumption is about 6 μA.

With reference to FIG. 8, the remote module 110 is in the standby mode and awaiting for activation (at step 310), which is caused by triggering a breakaway event as described above. The remote module 110 checks continuously whether an event has been triggered (at step 315). Once the event has been triggered, the remote module 110 enters the TRANSMIT mode (at step 320). In the TRANSMIT status, the remote module 110 transmits packets of information to the base module 95. The information transmitted includes the status of the switches 120, 125, and 130, and the battery voltage or other status data. This "other status data" may include battery current or such other parameter as may, for that type of battery, indicate the expected life of the battery from that point forward. The status and/or change of status of the switches 120, 125, and 130, and the battery 155 is transmitted to the base mode 95 only once, thus shortening the time frame the remote module is in the TRANSMIT mode and reducing the time during which there is a relatively high current being consumed by the remote module 110. The remote module 110 enters the AWAKE mode and determines whether a confirmation signal is sent from the base module 95 (at step 325). The confirmation signal from the base module 95 confirms a successful transmission of the status of the status of the switches 120, 125, and 130, and the battery 155. If the confirmation signal is not received, the remote module 110 enters the TRANSMIT mode and sends the status information to the base module 95 (at step 320).

Once the confirmation signal is received by the remote module 110, the remote module checks the current status of the switches 120, 125, and 130, and the battery 155 with the status last transmitted (at step 330). If the remote module 110 determines that the status has changed, then the remote module 110 enters the TRANSMIT mode and sends to the base module 95 the current status of the switches 120, 125, and 130, and the battery 155 (at step 320). If the status has not changed, the remote module 110 enters the DOZE mode and clears and starts a timer identified as "ticks-till-sleep" (at step 335) that controls the amount of time the remote module 110 is in the DOZE mode. Subsequently, the remote module 110 checks whether the remote module has been in the DOZE mode about a predetermined amount of time, for example 4 seconds (at step 340). If the remote module has been in the DOZE mode for over 4 seconds, the remote module enters the TRANSMIT mode and sends the updated status of the switches 120, 125, and 130, and the battery 155 to the base module (at step 320).

If the remote module 110 determines that the remote module 110 has not been in the DOZE mode for over 4 seconds, the remote module 110 checks whether ticks-till-sleep has expired (at step 345). In other words, the remote module 110 checks whether the remote module 110 has been in the DOZE mode for a sufficient amount of time, which is generally less than 4 seconds. If ticks-till-sleep has not expired, the remote module 110 checks whether an event has been triggered (at step 350) and whether the motion sensors 160 have been triggered (at step 355), if no event has occurred. It can be observed that the software in the remote module 110 forms a loop including steps 340, 345, 350, 355, and alternatively 335. One purpose of the loop is to maintain the controller of the remote module 110 active as long as there is motion detected by the motion detectors 160 (at step 355). For example, if motion is being detected (at step 355) but no change of status of the switches 120, 125, and 130, and the battery 155 is detected (at step 350), ticks-till-sleep keeps getting cleared (at step 335), thus ticks-till-sleep does not expire (at step 345). Eventually, the remote module 110 stays in the DOZE mode over 4 seconds (at step 340) and enters the TRANSMIT mode to send the status of the switches 120, 125, and 130, and the battery 155 to the base module 95 (at step 320).

If no event is triggered (at step 350) and no motion is detected (at step 355), then ticks-till-sleep eventually expires (at step 345) and the remote module proceeds to shut down the RF module (at step 360) and the USART (at step 365) to enter the SLEEP mode. In the SLEEP mode, the watchdog timer 305 starts counting and the remote module 110 checks whether the watchdog timer has expired (at step 370). If the watchdog timer has not expired, the remote module 110 checks whether the switches 120, 125, and 130 or the motion detectors 160 have been triggered (at step 375). As shown in FIG. 8, the software in the remote module 110 forms another loop controlled by the watchdog timer 305 and including steps 370 and 375. Under the assumption that no events are triggered or motion is detected (at step 375) for an extended period of time, the remote module 110 only exits the SLEEP mode when the watchdog timer 305 has expired (at step 370). Furthermore, software of the remote module 110 is designed such that expiration time of the watchdog timer 305 increases as the remote module 110 continuously exits the SLEEP mode only due to the expiration of the watchdog timer 305. In one example, the expiration time for the watchdog timer 305 is set to 4 seconds. If no events are triggered, no motion is detected, and the remote module 110 continuously exits the SLEEP mode when the watchdog timer 305 is expired, the expiration time for the watchdog timer 305 can continuously increase, every time the remote module 110 enters the SLEEP mode, to a period of time up to about 30 minutes.

When the watchdog timer 305 expires (at step 370), or an event is triggered or motion is detected (at step 375), the remote module 110 exits the SLEEP mode and enters the DOZE mode by clearing the timer identified as "ticks-till-ready" (at step 380). Once ticks-till-ready is cleared, the remote module 110 starts or powers the USART (at step 385), ticks-till-ready starts counting (at step 390), and the remote module 110 starts or powers the RF module 150 (at step 395). Subsequently, the remote module 110 checks the status of the switches 120, 125, and 130 and the battery 155 (at step 400). It can be observed that when an event is triggered at step 350, the software of the remote module 110 continues to step 400. At step 400, the event detected in step 350 or step 375 is considered "unfiltered". Accordingly, the software of the remote module 110 includes a software filter to process signals potentially generated by the detection devices 115. More specifically, the software filter helps determined whether an event has been triggered, thus identified as "filtered" event, or an energy spike as mistakenly sensed as an event (at step 405). If no event has occurred, the remote module 110 stays in the DOZE mode, and clears and starts ticks-till-sleep timer (at step 335).

In the case when the event is recognized as a filtered event (at step 405), the remote module 110 enters the AWAKE mode and verifies whether ticks-till-ready has expired (at step 410). The ticks-till-ready timer is generally set to a relatively short amount of time, for example between about 10 ms and 16 ms. One purpose of the ticks-till-ready timer is to give the USART and RF module 150 sufficient time to be enable to properly transmit information to the base module 95. Once ticks-till-ready has expired, the remote module 110 enters the TRANSMIT mode to transmit the status of the switches 120, 125, and 130 and the battery 155 to the base module 95 (at step 320).

It can be observed that the software of the remote module 110 is designed for the remote module 110 to operate in low power consumption modes (e.g. DOZE mode and SLEEP mode) a relatively high percentage of the time, thus helping the remote module 110 to extend battery life. In some applications, it is envisioned that this measure allows the remote module 110 to extend the functional battery life to about 10 years or more, at least 67% more than the six year functional life normally expected of a similar battery. In one example, it was determined through experimentation that the remote module operated nearly 99% of the time in SLEEP mode, thereby significantly reducing battery usage. It can also be observed that the remote module 110 starts or powers the USART and RF module 150 immediately after an event is potentially triggered. Moreover, the remote module 110 starts or powers the USART and RF module 150 prior to filtering the potentially detected event, thus setting the remote module 110 in the full ready status. This sequence of operation reduces the response time of the remote module 110 to an event by a factor of about ⅓.

Various features and advantages of the invention are set forth in the following claims.

What is claimed is:

1. A door system adapted to be mounted to a structure, the door system comprising:

a support connected to the structure;

a door mounted on the support and movable relative to the support between an opened position and a closed position, the door including a detection device coupled to the door, and a remote module coupled to the detection device, the remote module including a battery for powering the remote module, supporting two-way communication, and sending signals indicative of the status of the detection device and the battery;

a motor coupled to the door to drive the door;

a controller coupled to the motor to control the motor, the controller including a user interface and a memory; and a base module coupled to the controller for receiving signals from the remote module, the received signals indicative of the status of the detection device and the battery, and sending signals related to successful transmission acknowledgements to the remote module.

2. The system of claim 1, wherein the remote module includes an RF module for supporting wireless, two-way communication with the base module.

3. The system of claim 1, wherein the door mounted on the support is a roll-up door.

4. The system of claim 1, wherein the detection device includes a tape switch for detecting an object restricting vertical movement of the door.

5. The system of claim 4, wherein the tape switch includes a first conductive path and a second conductive path connected in series configuration with a resistor.

6. The system of claim 1, further comprising a second detection device coupled to one side of the door, and a third detection device coupled to another side of the door opposite to the one side of the door.

7. The system of claim 6, wherein the second detection device is a first breakaway switch operable to define the status of the one side of the door with respect to one vertical support.

8. The system of claim 6, wherein the third detection device is a second breakaway switch operable to define the status of the another side of the door with respect to another vertical support.

9. The system of claim 1, wherein the remote module includes a sensor operable to detect movement of the door.

10. The system of claim 9, wherein the sensor is oriented with respect to the remote module to detect vertical movement of the door.

11. The system of claim 1, wherein the remote module includes a temperature sensor.

12. A method of operating a door system including a door mounted on a support and movable relative to the support between an opened position and a closed position, the door having a detection device, a remote module coupled to the detection device, the remote module including a battery for powering the remote module, and an RF module for supporting two-way communication, a motor for driving the door, a controller for controlling the motor, and a base module coupled to the controller, the base module supporting two-way communication with the remote module, the method comprising:

operating the remote module in a first mode of the system;

transmitting a signal with the remote module, the signal indicative of the status of the detection device and the battery;

operating the motor with the controller based on the signal transmitted;

operating the remote module in a second mode of the system;

transmitting another signal with the base module, the signal indicative of an acknowledgement of reception of the signal from the remote module;

operating the remote module in a third mode of the system;

shutting down the RF module;

operating the remote module in a fourth mode of the system;

switching operation of the remote module to the first mode in response to a watchdog timer expiring.

13. The method of claim 12, further comprising switching operation of the remote module to the first mode in response to the remote module sensing a change of status of the detection device.

14. The method of claim 12, further comprising filtering a signal indicative of a change of status of the detection device.

15. The method of claim 12, further comprising incrementing the expiration term of the watchdog timer in response to the remote module continuously switching operation from the fourth mode to the first mode due to expiration of the watchdog timer.

16. The method of claim 12, further comprising starting the RF module in response to a watchdog timer expiring.

17. The method of claim 12, further comprising starting the RF module in response to the remote module sensing a change of status of the detection device.

18. The method of claim 12, further comprising operating the remote module in the fourth mode about at least 90% of the time.

19. The method of claim 12, further comprising using a first electric current rate in the first mode, using a second electric current rate in the second mode, the first current rate different than the second rate, using a third current rate in the third mode, the third current rate different than the first rate and the second rate, and using a fourth current rate in the fourth mode, the fourth current rate different than the first rate, the second rate, and the third rate.

20. The method of claim 19, wherein the first rate is larger than the second rate, the second rate is larger than the third rate, and the third rate is larger than the fourth rate.

21. A method of operating a remote module coupled to a detection device, the remote module including a battery for powering the remote module and an RF module, the remote module supporting wireless two-way communication with a base module, the method comprising:

in a first mode, transmitting a signal indicative of the status of the detection device and the battery;

coupling the transmitted signal received at the base module to a controller;

operating a motor with the controller based on the transmitted signal, wherein the motor drives a door;

switching from the first mode to a second mode in response to transmitting the signal, electric current consumption in the first mode being larger than in the second mode;

in the second mode, verifying if another signal transmitted from the base module has been received, the another signal indicative of a transmission acknowledgment;

verifying the status of the detection device and the battery;

switching from the second mode to a third mode in response to the remote module verifying that the status is the same as the status transmitted in the first mode, electric current consumption in the second mode being larger than in the third mode;

in the third mode, verifying that a timer has expired, the timer at least partially defining the amount of time the remote module operates in the third mode;

shutting down the RF module in response to the timer being expired;

switching from the third mode to a fourth mode in response to shutting down the RF module, electric current consumption in the third mode being larger than in the fourth mode;

in the fourth mode, verifying that a watchdog timer has expired; and switching from the fourth mode to the first mode in response to the watchdog timer expiring.

22. The method of claim 21, further comprising:

in the second mode, switching to the first mode if the another signal is not received; and switching to the first mode if the remote module determines that status of the detection device and the battery changed from the status transmitted in the first mode.

23. The method of claim 21, further comprising in the third mode, switching to the first mode in response to the remote module operating in the third mode over a predetermined period of time, the predetermined period of time being larger than the expiration time of the timer.

24. The method of claim 21, further comprising in the third mode, verifying if the status of the detection device has changed.

25. The method of claim 24, further comprising:

filtering a signal generated by the detection device indicative of a change of status of the detection device; and switching to the first mode in response to the change of status of the detection device.

26. The method of claim 25, further comprising:

switching to the second mode in response to filtering the signal indicative of change of status of the detection device; and verifying that another timer has expired.

27. The method of claim 24, further comprising verifying if motion is detected with a motion sensor in response to the status of the detection device not changing.

28. The method of claim 21, further comprising switching to the third mode, starting the RF module, and switching to the second mode in response to starting the RF module.

29. The method of claim 21, further comprising:

in the fourth mode, verifying if the status of the detection device has changed in response to the watchdog timer not being expired; and switching to the first mode in response to the remote module determining that the status has changed from the status transmitted in the first mode.

30. The method of claim 21, wherein the signal transmitted in the first mode includes a short burst of coded packets of information indicative of the status of the detection device and the battery.

* * * * *